US007815273B2

(12) United States Patent
Bruce et al.

(10) Patent No.: US 7,815,273 B2
(45) Date of Patent: Oct. 19, 2010

(54) FLUID EJECTION DEVICE

(75) Inventors: Kevin Bruce, Vancouver, WA (US); Trudy Benjamin, Portland, OR (US); Joe Torgerson, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 307 days.

(21) Appl. No.: 12/205,713

(22) Filed: Sep. 5, 2008

(65) Prior Publication Data

US 2009/0244132 A1 Oct. 1, 2009

Related U.S. Application Data

(60) Provisional application No. 61/041,585, filed on Apr. 1, 2008.

(51) Int. Cl.
*B41J 29/38* (2006.01)

(52) U.S. Cl. ..... 347/12

(58) Field of Classification Search ..... 347/5, 347/9, 12, 13, 57–59
See application file for complete search history.

(56) References Cited

U.S. PATENT DOCUMENTS

| | | | | |
|---|---|---|---|---|
| 5,838,339 | A | 11/1998 | Silverbrook | |
| 6,533,395 | B2 | 3/2002 | Dante et al. | |
| 6,439,697 | B1 * | 8/2002 | Axtell et al. | 347/57 |
| 6,443,558 | B1 | 9/2002 | Silverbrook | |
| 6,585,339 | B2 | 7/2003 | Schloeman et al. | |
| 6,607,257 | B2 | 8/2003 | Szumla et al. | |
| 6,623,108 | B2 | 9/2003 | Silverbrook | |
| 6,634,735 | B1 | 10/2003 | Silverbrook | |
| 6,739,700 | B2 | 5/2004 | Dante et al. | |
| 6,808,253 | B2 | 10/2004 | Silverbrook | |
| 7,111,924 | B2 | 9/2006 | Silverbrook | |
| 2004/0252174 | A1 | 12/2004 | Baxter et al. | |
| 2005/0157040 | A1 | 7/2005 | Silverbrook et al. | |
| 2005/0157061 | A1 | 7/2005 | Silverbrook | |
| 2005/0168543 | A1 | 8/2005 | Silverbrook et al. | |
| 2005/0231536 | A1 * | 10/2005 | Benjamin et al. | 347/9 |
| 2005/0231540 | A1 * | 10/2005 | Benjamin et al. | 347/12 |
| 2005/0231545 | A1 * | 10/2005 | Benjamin et al. | 347/19 |
| 2005/0231562 | A1 * | 10/2005 | Torgerson et al. | 347/65 |
| 2006/0098044 | A1 | 5/2006 | Jackson Pulver et al. | |
| 2007/0064055 | A1 | 3/2007 | Silverbrook et al. | |
| 2007/0097178 | A1 * | 5/2007 | Benjamin et al. | 347/57 |
| 2008/0204493 | A1 * | 8/2008 | Benjamin et al. | 347/11 |
| 2009/0002416 | A1 * | 1/2009 | Benjamin | 347/11 |
| 2009/0046117 | A1 * | 2/2009 | Benjamin et al. | 347/11 |
| 2009/0058896 | A1 * | 3/2009 | Benjamin | 347/9 |
| 2009/0109253 | A1 * | 4/2009 | Benjamin et al. | 347/9 |

* cited by examiner

*Primary Examiner*—Julian D Huffman

(57) ABSTRACT

A fluid ejection device includes groups of firing cells, sharing a common fire signal and a common address selection mechanism, each firing cell having a drop generator for ejecting fluid and a dynamic memory addressable by the common address selection mechanism. Circuitry interfaces with the firing cells to allow the capture of data during two consecutive select cycles, then firing of all cells during a third cycle.

16 Claims, 9 Drawing Sheets

FLUID EJECTION DEVICE

CROSS-REFERENCE TO RELATED APPLICATIONS

This Application claims the benefit of U.S. Provisional patent application Ser. No. 61/041,585, filed Apr. 1, 2008, which is hereby incorporated by reference in it's entirety.

BACKGROUND

An inkjet printing system, as one embodiment of a fluid ejection system, can include a printhead, an ink supply that provides liquid ink to the printhead, and an electronic controller that controls the printhead. The printhead, as one embodiment of a fluid ejection device, ejects ink drops through a plurality of orifices or nozzles. The ink is projected toward a print medium, such as a sheet of paper, to print an image onto the print medium. The nozzles are typically arranged in one or more arrays, such that properly sequenced ejection of ink from the nozzles causes characters or other images to be printed on the print medium as the printhead and the print medium are moved relative to each other.

In a typical thermal inkjet printing system, the printhead ejects ink drops through nozzles by rapidly heating small volumes of ink located in vaporization chambers. The ink is heated with small electric heaters, such as thin film resistors referred to herein as firing resistors. Heating the ink causes the ink to vaporize and be ejected through the nozzles.

To eject one drop of ink, the electronic controller that controls the printhead activates an electrical current from a power supply external to the printhead. The electrical current is passed through a selected firing resistor to heat the ink in a corresponding selected vaporization chamber and eject the ink through a corresponding nozzle. Known drop generators include a firing resistor, a corresponding vaporization chamber, and a corresponding nozzle.

As inkjet printheads have evolved, the number of drop generators in a printhead has increased to improve printing speed and/or quality. The increase in the number of drop generators per printhead has resulted in a corresponding increase in the number of input pads required on a printhead die to energize the increased number of firing resistors. In one type of printhead, each firing resistor is coupled to a corresponding input pad to provide power to energize the firing resistor. One input pad per firing resistor becomes impractical as the number of firing resistors increases.

Manufacturers continue increasing the number of drop generators per input pad via reducing the number of input pads and/or increasing the number of drop generators on a printhead die. A printhead with fewer input pads typically costs less than a printhead with more input pads. Also, a printhead with more drop generators typically prints with higher quality and/or printing speed.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1:
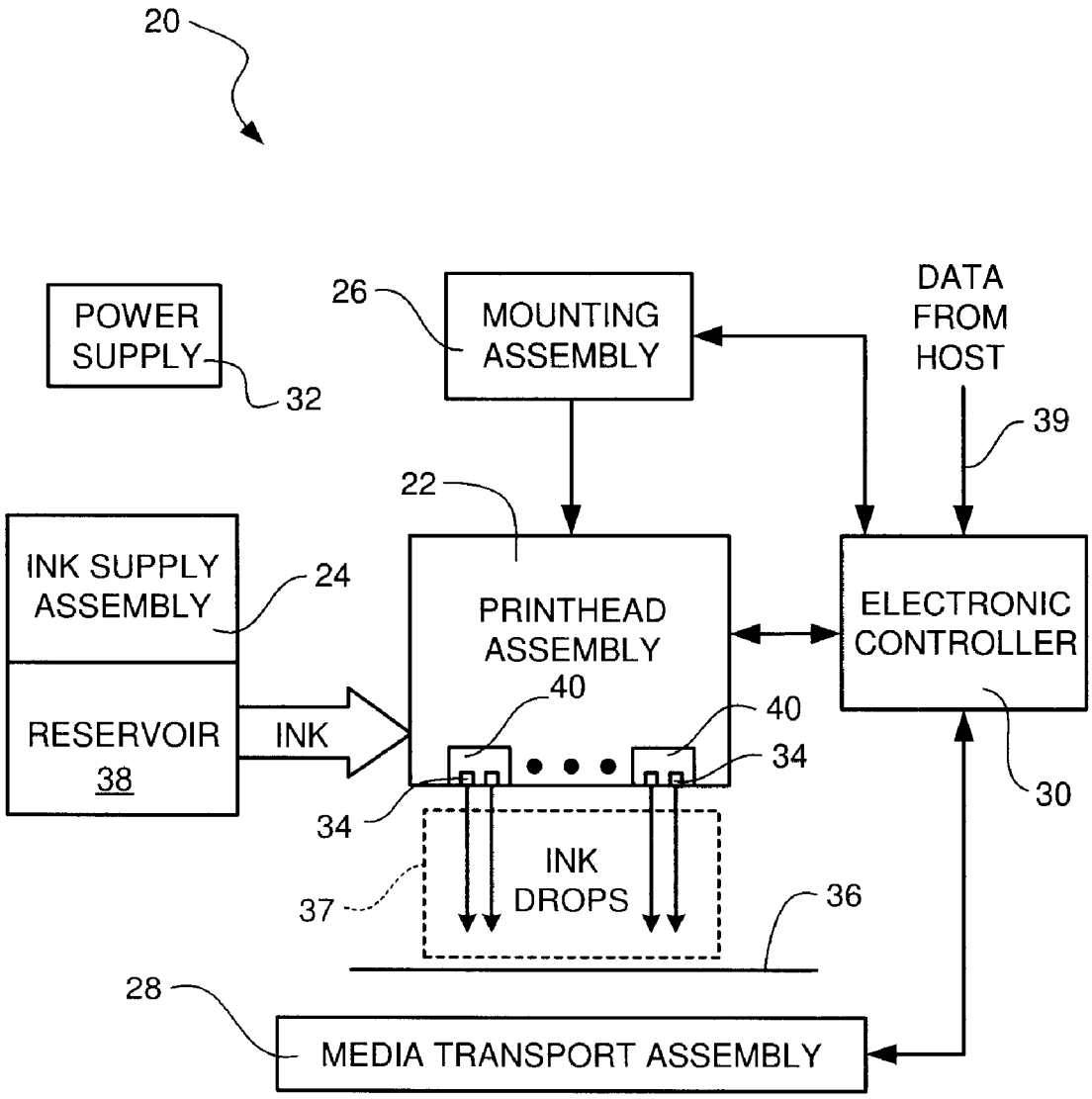
FIG. 1 is a block diagram of one embodiment of an ink jet printing system, as one embodiment of a fluid ejection system.

Reference will now be made to exemplary embodiments illustrated in the drawings, and specific language will be used herein to describe the same. As used herein, directional terms, such as "top," "bottom," "front," "back," "leading," "trailing," etc, are used with reference to the orientation of the figures being described. Because components of various embodiments disclosed herein can be positioned in a number of different orientations, the directional terminology is used for illustrative purposes only, and is not intended to be limiting. It is also to be understood that the exemplary embodiments illustrated in the drawings, and the specific language used herein to describe the same are not intended to limit the scope of the present disclosure. Alterations and further modifications of the features illustrated herein, and additional applications of the principles illustrated herein, which would occur to one skilled in the relevant art and having possession of this disclosure, are to be considered within the scope of this disclosure.

As used herein, the term "fluid ejection device" is intended to refer generally to any drop-on-demand fluid ejection system, and the terms "printhead" and "printer" are intended to refer to the same type of system. It is to be understood that where the description presented herein depicts or discusses an embodiment of an ink jet printing system, this is only one embodiment of a drop-on-demand fluid ejection system that can be configured in accordance with the present disclosure.

Where this disclosure refers to "ink", that term is to be understood as just one example of a fluid that can be ejected from a drop-on-demand fluid ejection device in accordance with this disclosure. Many different kinds of liquid fluids can be ejected from drop-on-demand fluid ejection systems, such as food products, chemicals, pharmaceutical compounds, fuels, etc. The term "ink" is therefore not intended to limit the system to ink, but is only exemplary of a liquid that can be used. Additionally, the terms "print" or "printing" and "ink jet" are intended to generally refer to fluid ejection onto any substrate for any purpose, and are not limited to providing visible images on paper or the like.

FIG. 1 illustrates one embodiment of an inkjet printing system 20. Inkjet printing system 20 constitutes one embodiment of a fluid ejection system that includes a fluid ejection device, such as inkjet printhead assembly 22, and a fluid supply assembly, such as ink supply assembly 24 having an ink reservoir 38. The inkjet printing system 20 also includes a mounting assembly 26, a media transport assembly 28, and an electronic controller 30. At least one power supply 32 provides power to the various electrical components of inkjet printing system 20.

In one embodiment, inkjet printhead assembly 22 includes at least one printhead or printhead die 40 that ejects drops of ink through a plurality of orifices or nozzles 34 toward a print medium 36 so as to print onto print medium 36. Printhead 40 is one embodiment of a fluid ejection device. Print medium 36 may be any type of suitable sheet material, such as paper, card stock, transparencies, Mylar, fabric, and the like. Typically, nozzles 34 are arranged in one or more columns or arrays such that properly sequenced ejection of ink from nozzles 34 causes characters, symbols, and/or other graphics or images to be printed upon print medium 36 as inkjet printhead assembly 22 and print medium 36 are moved relative to each other. While the following description refers to the ejection of ink from printhead assembly 22, it is understood that other liquids, fluids or flowable materials, including clear fluid, may be ejected from printhead assembly 22.

Mounting assembly 26 positions inkjet printhead assembly 22 relative to media transport assembly 28 and media transport assembly 28 positions print medium 36 relative to inkjet printhead assembly 22. Thus, a print zone 37 is defined adjacent to nozzles 34 in an area between inkjet printhead assembly 22 and print medium 36. In one embodiment, inkjet printhead assembly 22 is a scanning type printhead assembly. As such, mounting assembly 26 includes a carriage (not shown) for moving inkjet printhead assembly 22 relative to media transport assembly 28 to scan print medium 36. In another embodiment, inkjet printhead assembly 22 is a non-scanning type printhead assembly. As such, mounting assembly 26 fixes inkjet printhead assembly 22 at a prescribed position relative to media transport assembly 28. Thus, media transport assembly 28 positions print medium 36 relative to inkjet printhead assembly 22.

Electronic controller or printer controller 30 typically includes a processor, firmware, and other electronics, or any combination thereof, for communicating with and controlling inkjet printhead assembly 22, mounting assembly 26, and media transport assembly 28. Electronic controller 30 receives data 39 from a host system, such as a computer, and usually includes memory for temporarily storing data 39. Typically, data 39 is sent to inkjet printing system 20 along an electronic, infrared, optical, or other information transfer path. Data 39 represents, for example, a document and/or file to be printed. As such, data 39 forms a print job for inkjet printing system 20 and includes one or more print job commands and/or command parameters.

In one embodiment, electronic controller 30 controls inkjet printhead assembly 22 for ejection of ink drops from nozzles 34. As such, electronic controller 30 defines a pattern of ejected ink drops that form characters, symbols, and/or other graphics or images on print medium 36. The pattern of ejected ink drops is determined by the print job commands and/or command parameters.

In one embodiment, inkjet printhead assembly 22 includes one printhead 40. In another embodiment, inkjet printhead assembly 22 is a wide-array or multi-head printhead assembly. In one wide-array embodiment, inkjet printhead assembly 22 includes a carrier, which carries printhead dies 40, provides electrical communication between printhead dies 40 and electronic controller 30, and provides fluidic communication between printhead dies 40 and ink supply assembly 24.

Figure 2:
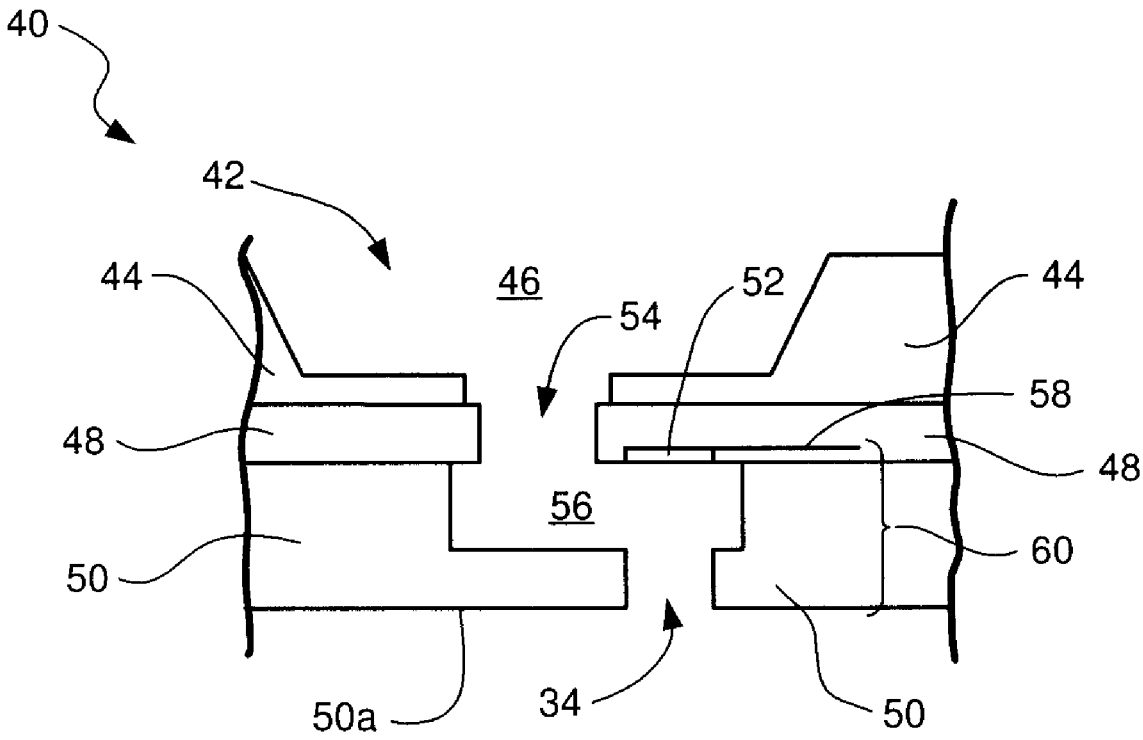
FIG. 2 is a cross-sectional diagram of a portion of a printhead die.

FIG. 2 is a diagram illustrating a portion of one embodiment of a printhead die 40. The printhead die 40 includes an array of printing or fluid ejecting elements 42. Printing elements 42 are formed on a substrate 44, which has an ink feed slot 46 formed therein. As such, ink feed slot 46 provides a supply of liquid ink to printing elements 42. Ink feed slot 46 is one embodiment of a fluid feed source. Other embodiments of fluid feed sources include but are not limited to corresponding individual ink feed holes feeding corresponding vaporization chambers and multiple shorter ink feed trenches that each feed corresponding groups of fluid ejecting elements. A thin-film structure 48 has an ink feed channel 54 formed therein which communicates with ink feed slot 46 formed in substrate 44. An orifice layer 50 has a front face 50*a* and a nozzle opening 34 formed in front face 50*a*. Orifice layer 50 also has a nozzle chamber or vaporization chamber 56 formed therein which communicates with nozzle opening 34 and ink feed channel 54 of thin-film structure 48. A firing resistor 52 is positioned within vaporization chamber 56 and leads 58 electrically couple firing resistor 52 to circuitry controlling the application of electrical current through selected firing resistors. A drop generator 60 as referred to herein includes firing resistor 52, nozzle chamber or vaporization chamber 56 and nozzle opening 34.

During printing, ink flows from ink feed slot 46 to vaporization chamber 56 via ink feed channel 54. Nozzle opening 34 is operatively associated with firing resistor 52 such that droplets of ink within vaporization chamber 56 are ejected through nozzle opening 34 (e.g., substantially normal to the plane of firing resistor 52) and toward print medium 36 upon energization of firing resistor 52.

Example embodiments of printhead dies 40 include a thermal printhead, a piezoelectric printhead, an electrostatic printhead, or any other type of fluid ejection device known in the art that can be integrated into a multi-layer structure. Substrate 44 is formed, for example, of silicon, glass, ceramic, or a stable polymer and thin-film structure 48 is formed to include one or more passivation or insulation layers of silicon dioxide, silicon carbide, silicon nitride, tantalum, polysilicon glass, or other suitable material. Thin-film structure 48, also, includes at least one conductive layer, which defines firing resistor 52 and leads 58. The conductive layer is made, for example, to include aluminum, gold, tantalum, tantalum-aluminum, or other metal or metal alloy. In one embodiment, firing cell circuitry, such as described in detail below, is implemented in substrate and thin-film layers, such as substrate 44 and thin-film structure 48. Suitable materials and methods for fabricating the orifice layer are known to those of skill in the art.

Figure 3:
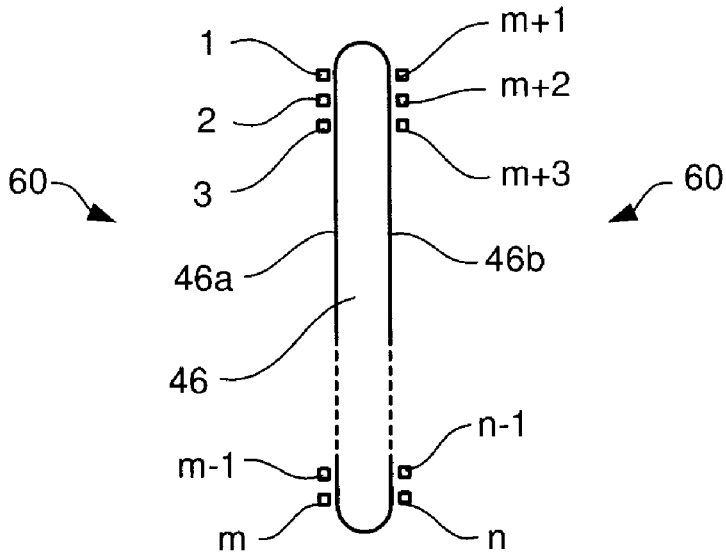
FIG. 3 is a diagram illustrating a layout of drop generators located along an ink feed slot in one embodiment of a printhead die.

FIG. 3 is a diagram illustrating drop generators 60 located along ink feed slot 46 in one embodiment of printhead die 40. Ink feed slot 46 includes opposing ink feed slot sides 46*a* and 46*b*. Drop generators 60 are disposed along each of the opposing ink feed slot sides 46*a* and 46*b*. A total of n drop generators 60 are located along ink feed slot 46, with m drop generators 60 located along ink feed slot side 46*a*, and n−m drop generators 60 located along ink feed slot side 46*b*. In one embodiment, n equals 200 drop generators 60 located along ink feed slot 46 and m equals 100 drop generators 60 located along each of the opposing ink feed slot sides 46*a* and 46*b*. In other embodiments, any suitable number of drop generators 60 can be disposed along ink feed slot 46. While the configuration shown in FIG. 3 provides drop generators on both sides of the feed slot 46, it is to be appreciated that other configurations can also be used. For example, drop generators can be provided on only one side of an associated feed slot. Alternatively, multiple ink feed slots (e.g. two or more) can be associated with a single printhead die, and these multiple slots can be individually coupled to separate fluid reservoirs (e.g. for multiple colors of ink), or share single reservoirs.

Ink feed slot 46 provides ink to each of the n drop generators 60 disposed along ink feed slot 46. Each of the n drop generators 60 includes a firing resistor 52, a vaporization chamber 56 and a nozzle 34. Each of the n vaporization chambers 56 is fluidically coupled to ink feed slot 46 through at least one ink feed channel 54. The firing resistors 52 of drop generators 60 are energized in a controlled sequence to eject fluid from vaporization chambers 56 and through nozzles 34 to print an image on print medium 36.

Figure 4:
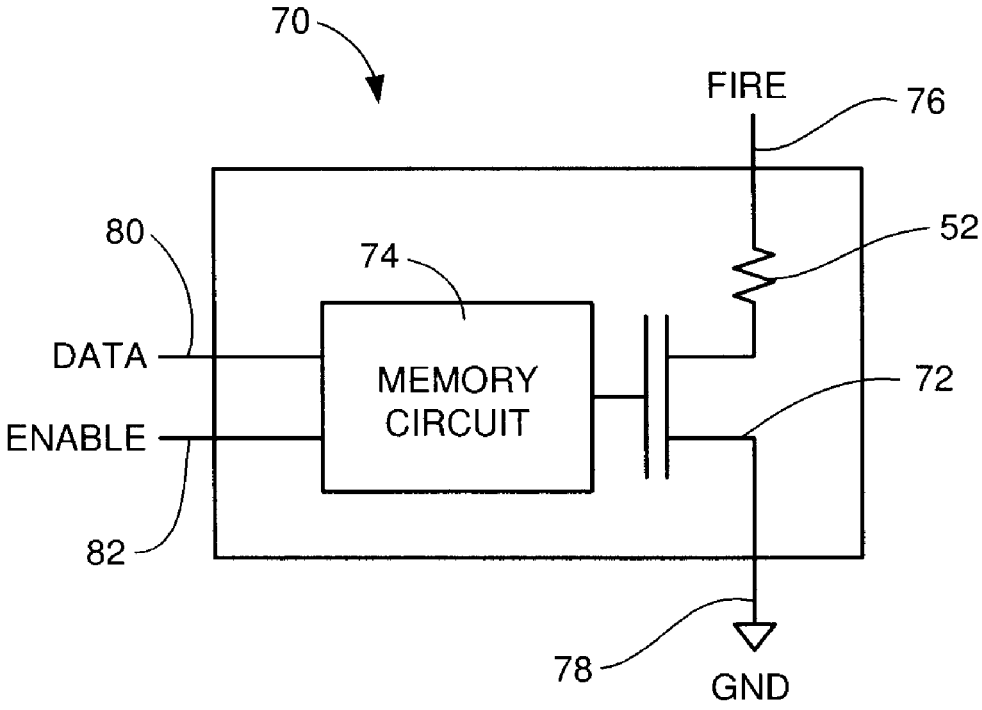
FIG. 4 is a high level schematic diagram of one embodiment of a firing cell that can be used in an embodiment of a printhead die.

FIG. 4 is a high level diagram illustrating one embodiment of a firing cell 70 employed in one embodiment of printhead die 40. Firing cell 70 includes a firing resistor 52, a resistor drive switch 72, and a memory circuit 74. Firing resistor 52 is part of a drop generator 60. Drive switch 72 and memory circuit 74 are part of the circuitry that controls the application of electrical current through firing resistor 52. Firing cell 70 is formed in thin-film structure 48 and on substrate 44.

In one embodiment, firing resistor 52 is a thin-film resistor and drive switch 72 is a field effect transistor (FET). Firing resistor 52 is electrically coupled to a fire line 76 and the drain-source path of drive switch 72. The drain-source path of drive switch 72 is also electrically coupled to a reference line 78 that is coupled to a reference voltage, such as ground. The gate of drive switch 72 is electrically coupled to memory circuit 74 that controls the state of drive switch 72.

Memory circuit 74 is electrically coupled to a data line 80 and enable lines 82. Data line 80 receives a data signal that represents part of an image and enable lines 82 receive enable signals to control operation of memory circuit 74. Memory circuit 74 stores one bit of data as it is enabled by the enable signals. The logic level of the stored data bit sets the state (e.g., on or off, conducting or non-conducting) of drive switch 72. The enable signals can include one or more select signals and one or more address signals.

Fire line 76 receives an energy signal comprising energy pulses and provides an energy pulse to firing resistor 52. In one embodiment, the energy pulses are provided by electronic controller 30 to have timed starting times and timed duration, resulting in timed end times, to provide a proper amount of energy to heat and vaporize fluid in the vaporization chamber 56 of a drop generator 60. If drive switch 72 is on (conducting), the energy pulse heats firing resistor 52 to heat and eject fluid from drop generator 60. If drive switch 72 is off (non-conducting), the energy pulse does not heat firing resistor 52 and the fluid remains in drop generator 60.

Figure 5:
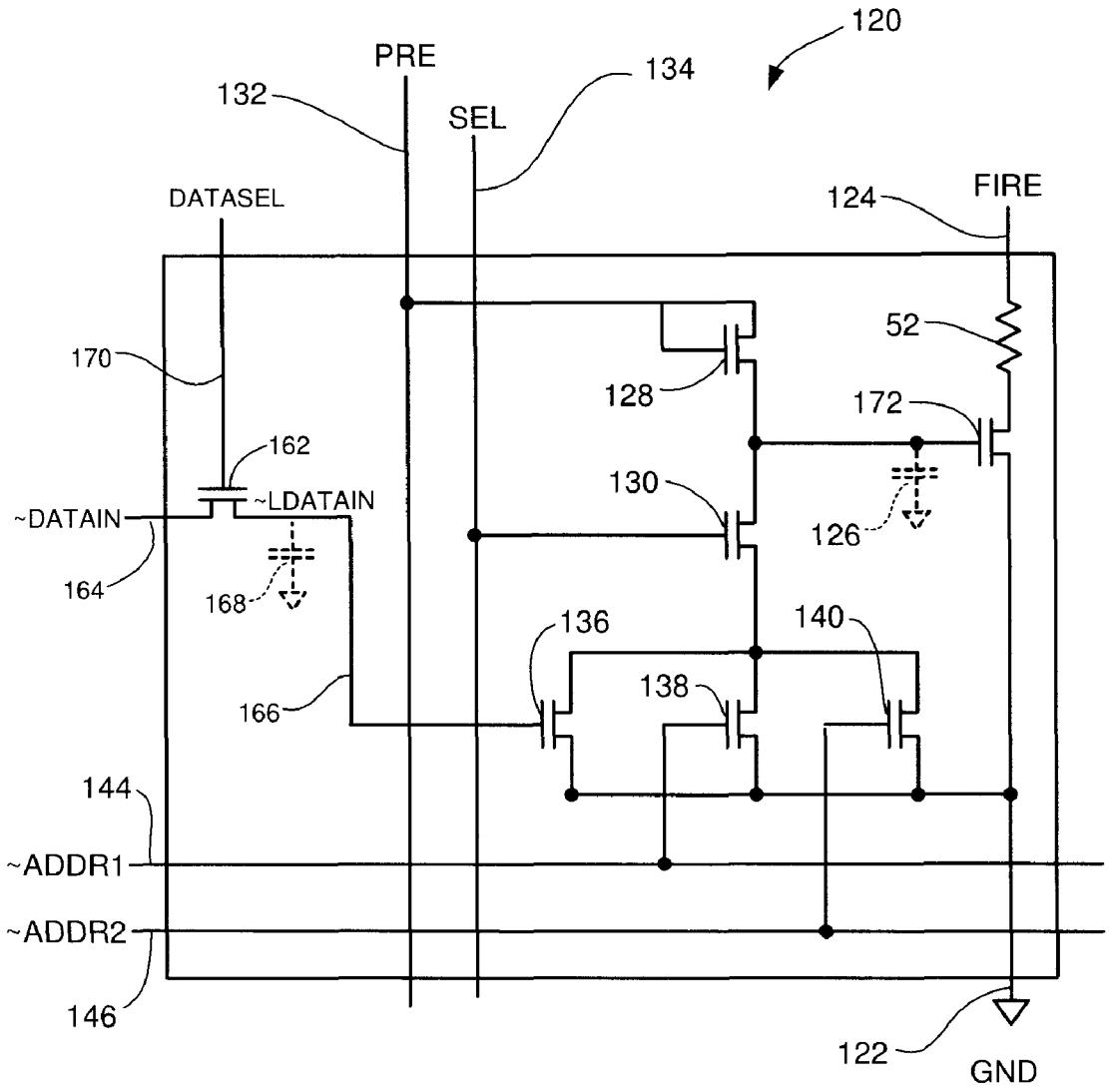
FIG. 5 is a lower level schematic diagram of one embodiment of a firing cell that can be used in an embodiment of a printhead die.

Shown in FIG. 5 is a lower level schematic diagram of one embodiment of a double data rate (DDR) firing cell 120. The firing cell 120 includes a drive switch 172 electrically coupled to a firing resistor 52. In one embodiment, drive switch 172 is a FET including a drain-source path electrically coupled at one end to one terminal of firing resistor 52 and at the other end to a reference line 122. The reference line 122 is tied to a reference voltage, such as ground. The other terminal of firing resistor 52 is electrically coupled to a FIRE line 124 that delivers energy pulses to firing resistor 52. The energy pulses energize firing resistor 52 if drive switch 172 is on (conducting).

The gate of drive switch 172 forms a storage node capacitance 126 that functions as a dynamic memory element to store data pursuant to the sequential activation of a pre-charge transistor 128 and a select transistor 130. The storage node capacitance 126 is shown in dashed lines, as it is part of drive switch 172. Alternatively, a capacitor separate from drive switch 172 can be used as a dynamic memory element.

The drain-source path and gate of pre-charge transistor 128 are electrically coupled to a pre-charge line 132 that receives a pre-charge signal. The gate of drive switch 172 is electrically coupled to the drain-source path of pre-charge transistor 128 and the drain-source path of select transistor 130. The gate of select transistor 130 is electrically coupled to a select line 134 that receives a select signal SEL. A pre-charge signal PRE is one type of pulsed charge control signal. Another type of pulsed charge control signal is a discharge signal employed in embodiments of a discharged firing cell.

A data transistor 136, a first address transistor 138 and a second address transistor 140 include drain-source paths that are electrically coupled in parallel. The parallel combination of data transistor 136, first address transistor 138 and second address transistor 140 is electrically coupled between the drain-source path of select transistor 130 and reference line 122. The serial circuit including select transistor 130 coupled to the parallel combination of data transistor 136, first address transistor 138 and second address transistor 140 is electrically coupled across node capacitance 126 of drive switch 172. The gate of data transistor 136 is electrically coupled to a latched data line 166 that receives a data signal ~DATAIN. The gate of first address transistor 138 is electrically coupled to an address line 144 that receives address signals ~ADDR1 and the gate of second address transistor 140 is electrically coupled to a second address line 146 that receives address signals ~ADDR2. The data signals ~DATAIN and address signals ~ADDR1 and ~ADDR2 are active when low as indicated by the tilda (~) at the beginning of the signal name. The node capacitance 126, pre-charge transistor 128, select transistor 130, data transistor 136, node capacitance 168 and address transistors 138 and 140 form a memory cell.

In operation, node capacitance 126 is pre-charged through pre-charge transistor 128 by providing a high level voltage pulse on pre-charge line 132. In one embodiment, before or during the high level voltage pulse on pre-charge line 132, a data signal ~DATAIN is provided on data line 164 to set the state of data transistor 136, and address signals ~ADDR1 and ~ADDR2 are provided on address lines 144 and 146 to set the states of first address transistor 138 and second address transistor 140. A high level voltage pulse is provided on select line 134 to turn on select transistor 130 and node capacitance 126 discharges if data transistor 136, first address transistor 138 and/or second address transistor 140 is on. Alternatively, node capacitance 126 remains charged if data transistor 136, first address transistor 138 and second address transistor 140 are all off.

Firing cell 120 is an addressed firing cell if both address signals ~ADDR1 and ~ADDR2 are low and node capacitance 126 either discharges if data signal ~DATAIN is high or remains charged if data signal ~DATAIN is low. Pre-charged firing cell 120 is not an addressed firing cell if at least one of the address signals ~ADDR1 and ~ADDR2 is high and node capacitance 126 discharges regardless of the data signal ~DATAIN voltage level. The first and second address transistors 136 and 138 comprise an address decoder, and data transistor 136 controls the voltage level on node capacitance 126 if firing cell 120 is addressed.

This firing cell embodiment includes a data latch transistor 162 that includes a drain-source path electrically coupled between data line 164 and latched data line 166. The data line 164 receives a data signal ~DATAIN, and data latch transistor 162 latches data into the firing cell to provide latched data signals ~LDATIN. The ~DATAIN and ~LDATAIN signals are active when low as indicated by the tilde (~) at the beginning of the signal name. The gate of data latch transistor 162 is electrically coupled to a data select line 170 that receives a data select signal DATASEL.

The data latch transistor 162 passes data from data line 164 to the latched data line 166 and a latched data storage node capacitance 168 via a high level data select signal. The data is latched onto the latched data line 166 and the latched data storage node capacitance 168 as the data select signal transitions from a high voltage level to a low voltage level. The latched data storage node capacitance 168 is shown in dashed lines, because it is part of data transistor 136. Alternatively, a capacitor separate from data transistor 136 can be used to store latched data.

The data select line 170 can be electrically coupled to a select line such as the pre-charge line 132. In other firing cells on the same printhead, the data select line 170 can be electrically coupled to other select lines that are not the pre-charge line 132 for the given firing cell. For example, in one embodiment, the gate of data latch transistor 162 can be electrically coupled to a pre-charge line of another fire group. In this embodiment, data signal ~DATAIN is received by data line 164 and passed to latched data line 166 and latched data storage node capacitance 168 via data latch transistor 162 by providing a high level voltage pulse on the pre-charge line of the other fire group. Data latch transistor 162 is turned off to provide latched data signals ~LDATAIN as the voltage pulse on the pre-charge line of the other fire group transitions from a high voltage level to a low level voltage. Storage node capacitance 126 is pre-charged through pre-charge transistor 128 via the high level voltage pulse on pre-charge line 132. The high voltage pulse on pre-charge line 132 occurs after the transition of the voltage pulse on the pre-charge line of the other fire group from a high voltage level to a low voltage level.

In another embodiment, the gate of a data latch transistor, such as data latch transistor 162, of a first pre-charged firing cell in the current fire group can be electrically coupled to a first pre-charge line of a first fire group that is different than the current fire group. Also, the gate of a data latch transistor, such as data latch transistor 162, of a second pre-charged firing cell in the current fire group can be electrically coupled to a second pre-charge line of a second fire group that is different than the first fire group and the current fire group. Data line 164 provides data during the high voltage levels of the pre-charge signals of the first and second fire groups. Data latched into the first and second pre-charged firing cells is used via the pre-charge and select signals of the current fire group. Other aspects of the configuration and operation of a double data rate firing cell configured in this way are disclosed in United States Patent Application Publication no. 2007/0097178.

Figure 6:
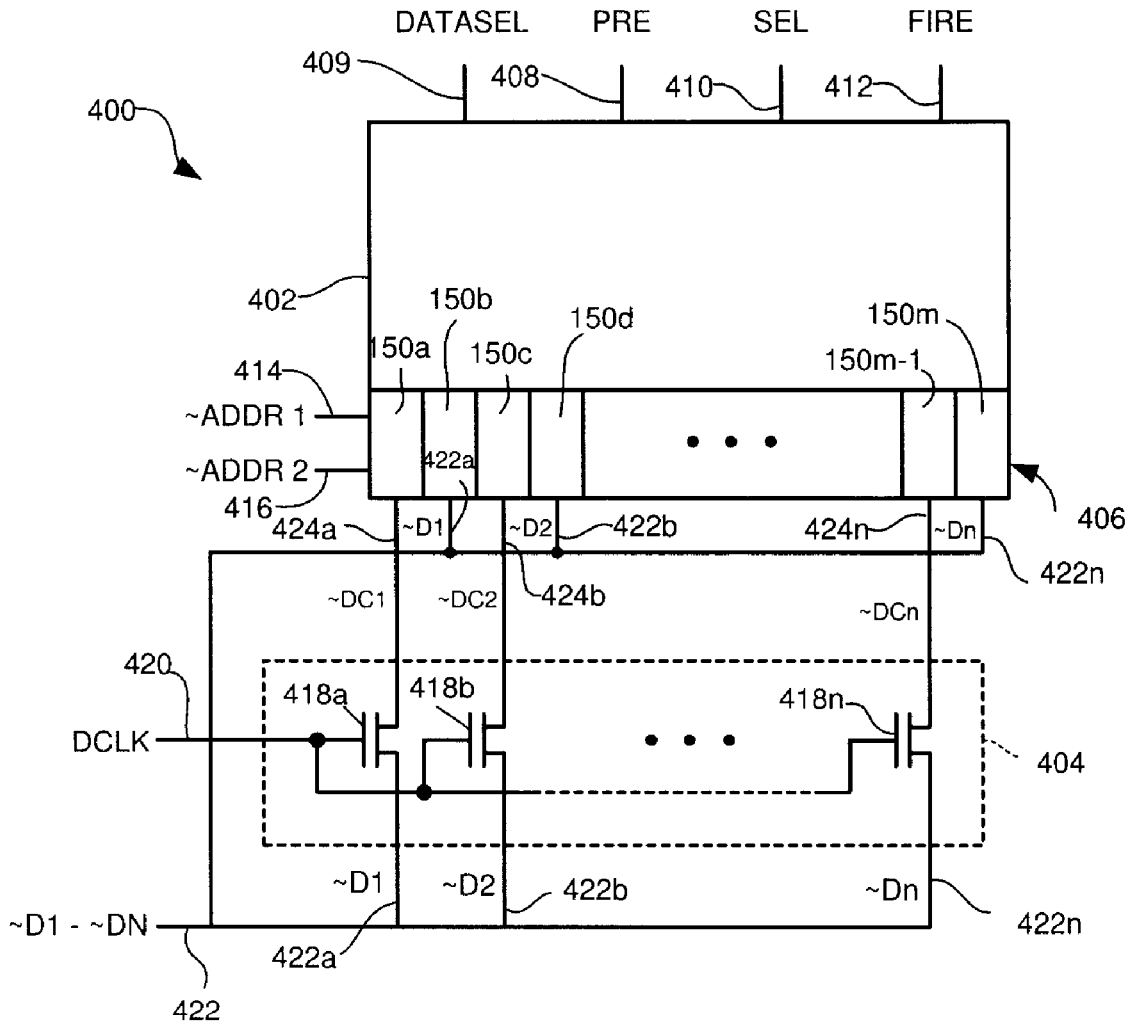
FIG. 6 is a schematic diagram of another embodiment of a double data rate circuit array having a clock latch circuit.

An array of double data rate firing cell circuits 400 is shown in the schematic diagram of FIG. 6. This diagram represents only a subset of one fire group 402, that might exist on a print head. It also shows an example row subgroup 406 containing a plurality of firing cells 150 that receive their address from the combination of first address signal 414 ~ADDR_1 and second address signal 416 ~ADDR_2. The row subgroup 406 includes firing cells 150*a*-150*m*. Other row subgroups would receive their first address and second address signals from a different combination of address lines. This array of double data rate firing cell circuits 400 also shows a clock latch circuit 404.

Each of the firing cells 150 in fire group 402 are electrically coupled to data select line 409 to receive signal DATA SEL, pre-charge line 408 to receive pre-charge signal PRE, select line 410 to receive select signal SEL and fire line 412 to receive fire signal FIRE. Each of the firing cells 150*a*-150*m* in row subgroup 406 is electrically coupled to first address line 414 to receive first address signal ~ADDR 1 and to second address line 416 to receive second address signal ~ADDR 2. The firing cells 150 receive signals and operate as described in the description of FIG. 5.

The clock latch circuit 404 includes clock latch transistors 418*a*-418*n*. The gate of each of the clock latch transistors 418*a*-418*n* is electrically coupled to a clock line 420 to receive data clock signal DCLK. The drain-source path of each of the clock latch transistors 418*a*-418*n* is electrically coupled to one of the data lines 422*a*-422*n* to receive one of the data signals ~D1-~Dn, indicated at 422. The other side of the drain source path of each of the clock latch transistors 418*a*-418*n* is electrically coupled to firing cells 150 in fire group 402 and in all the other fire groups in double data rate firing cell circuit 400 via corresponding clock data lines 424*a*-424*n*. Having all of the firing cells 150 in one data line group electrically coupled to a single one of the clock latch transistors 418*a*-418*n* ensures that there is enough capacitance on clocked data lines 424*a*-424*n* to ensure that charge sharing by clocked data signals ~DC1-~DCn is small enough to maintain a minimum high voltage level in data latched into the firing cells 150 as the pre-charge signal transitions to a low voltage level and as the data clock signal DCLK at 420 transitions to a low voltage level.

Other aspects of the configuration and operation of a double data rate firing cell circuit configured like that shown in FIG. 6 are disclosed in United States Patent Application Publication no. 2007/0097178. Each of the data signals ~D1-~Dn includes a first data bit during the first half of the high voltage pulse in data select signal DATASEL and a second data bit during the second, half of the high voltage pulse. Also, clock signal DCLK includes a high voltage pulse during the first half of the high voltage pulse in data select signal DATASEL. Thus the various double data rate firing cell circuit configurations latch two data bits from each of the data lines at each high voltage pulse in the data select signal.

Figure 7:
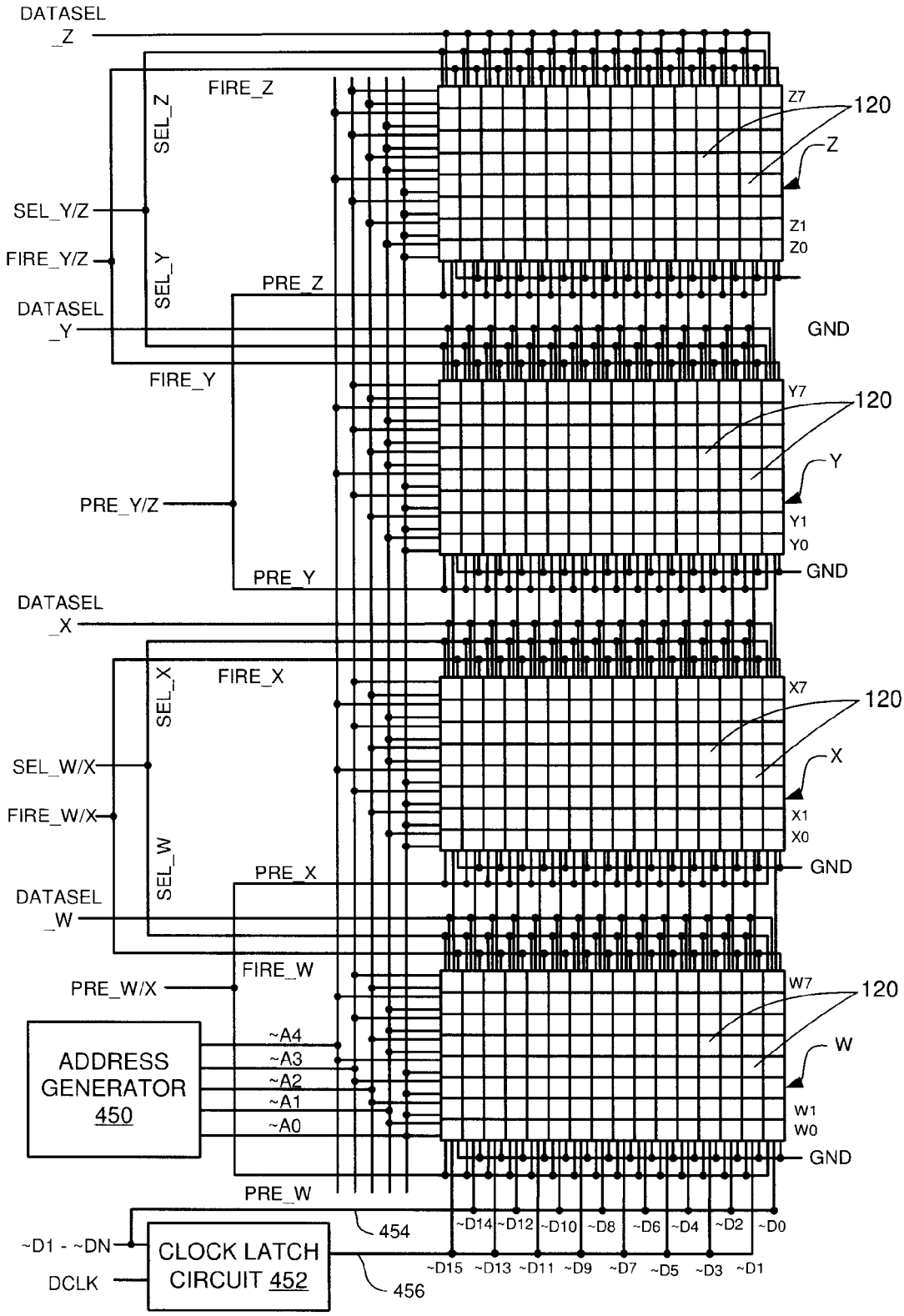
FIG. 7 is a schematic diagram of one embodiment of an inkjet printhead firing cell array having combined FIRE lines.

Provided in FIG. 7 is a schematic diagram of a fluid ejection firing array employing a plurality of dynamic memory based firing cells 120. These firing cells can be like those of FIG. 5. In the array of FIG. 7, the firing cells are arranged in rows and columns in four fire groups W, X, Y, Z. For reference, the rows of the respective fire groups W, X, Y and Z are respectively identified as rows W0 through W7, X0 through X7, Y0 through Y7 and Z0 through Z7. For convenience, the rows of firing cells are referred to as address rows or subgroups of firing cells, whereby each fire group includes a plurality of subgroups of firing cells.

Firing data signals are applied to data lines ~D0 through ~D15 that are associated with respective columns of all of the firing cells. The data lines are connected to the columns of the firing cell arrays via a first and second data bus 454, 456. While the data bus lines are shown as a single line, it is to be appreciated that this line represents a data bus including multiple individual data lines. The data lines provide direct driven signals and clocked data signals to alternating columns of the firing cell arrays. The clocked data signals are provided by the clock latch circuit 452, which functions as described above with respect to FIG. 6. The data lines ~D0 through ~D15 provide the ~DATAIN signal 164 that is shown in FIG. 5. Consequently, each of the data lines are connected to all of the gates of the data transistors of the firing cells 120 in an associated column, and each firing cell is connected to only one data line. Thus, each of the data lines provides energizing data to firing cells in multiple rows in multiple fire groups.

Address control signals are applied to address control lines ~A0 through ~A4 that are connected to the first and second address transistors (e.g. transistors 138, 140 in FIG. 5) of the cells of the rows of the array. In this manner, rows of firing cells are addressed by suitable set up of the address control lines ~A0 through ~A4. The address control lines can be connected to external control circuitry by appropriate interface pads. Alternatively, address generation can be provided by an address generator circuit 450 that is provided as part of the fluid ejection circuit array. In printer systems, on-board address generation involves providing an address generator on the printhead structure itself, rather than as part of the printer controller, and connected to the printhead by a plurality of address lines. Details regarding an on-board address generation system that can be used in the system disclosed herein are provided in U.S. patent application Ser. No. 10/827,163, which has been published as United States Patent Application Publication No. 2005/0230493, the disclosure of which is incorporated herein by reference in its entirety.

The address generator 450 comprises a cluster of circuits including a shift register, a programmable logic array, and direction control logic. The outputs from the address generator are provided on address lines ~A0 through ~A4, which are typically routed to the firing cells in pairs. (e.g. ~ADDR 1 and ~ADDR 2 in FIG. 5). Six outputs from the Address Generator is a common number, but more or less can be used. Six addresses can be combined as pairs to create 15 different pair combinations (e.g. 1&2, 1&3, etc.).

Pre-charge signals PRE are applied via pre-charge select control lines PRE_W, PRE_X, PRE_Y AND PRE_Z that are associated with the respective fire groups W, X, Y AND Z, and are connected to external control circuitry by appropriate interface pads. Each of the precharge lines is connected to all of the precharge transistors (128 in FIG. 5) in the associated fire group, and all firing cells in a fire group are connected to only one precharge line. This allows the state of the dynamic memory elements of all firing cells in a fire group to be set to a known condition prior to data being sampled. As can be seen in FIG. 7, the precharge lines for the firing groups W and X and groups Y and Z are tied together, and labeled PRE_W/X and PRE_Y/Z, respectively.

Select signals SEL are applied via select control lines SEL_W, SEL_X, SEL_Y and SEL_Z that are associated with the respective fire groups W, X, Y and Z, and are connected to external control circuitry. Each of the select control lines is connected to all of the select transistors (e.g. transistor 130 in FIG. 5) in the associated fire group, and all firing cells in a fire group are connected to only one select line. Thus, each row or subgroup of firing cells is connected to a common subset of the address and select control lines, namely the address control lines for the row position of the subgroup as well as the precharge select control line and the select control line for the fire group of the subgroup. Like the precharge lines, the select lines for the firing groups can also be tied together, and these are labeled SEL_W/X and SEL_Y/Z.

Heater resistor energizing FIRE signals are applied via fire lines FIRE_W, FIRE_X, FIRE_Y and FIRE_Z that are associated with the respective fire groups W, X, Y and Z, and each of the fire lines is connected to all of the heater resistors in the associated fire group. The fire lines are connected to external supply circuitry by appropriate interface pads, and all cells in a fire group share a common ground. Additionally, it can be seen that the fire lines for fire groups W and X are combined, as are the fire lines for groups Y and Z. The combination of these fire lines is made possible by a two cycle data capture method, as outlined more specifically below.

The PRE pulse is sent prior to assertion of the SEL signal. The PRE pulse defines a precharge time interval while the SEL signal defines a discharge time interval. Heater resistor energizing data is stored in the array one row of firing cells at time, one fire group at a time. The fire groups are selected iteratively. For each fire group a precharge pulse precedes a fire pulse.

A firing cell array like that of FIG. 7 can also be configured using firing cells having a different configuration than the firing cells of FIGS. 4 and 5. For example, various embodiments of double data rate (DDR) firing cell control circuits can be used, such as are disclosed in United States Patent Application Publication no. 2007/0097178, The embodiments shown in FIGS. 9-15 in the '178 application and the associated text are particularly relevant. The double data rate firing cell circuit configurations shown in the '178 application can latch two bits of data from each of the data lines at each high voltage pulse in a pre-charge signal. This allows nearly twice the number of firing resistors to be energized without changing the firing frequency or the number of input pads. This in turn allows a smaller number of data lines for a firing cell array having a given number of columns.

The firing array shown in FIG. 7 embodies one approach to reducing the number of input pads on the pen in order to decrease the width of the pen relative to its length. For basic addressing of a minimum array of ink jet nozzles, a certain number of interconnects (pins) are used to provide the basic infrastructure to provide nozzle addressing capability. For example, viewing FIGS. 5 and 7 together, each firing cell row includes connections to two address lines, and each column is connected to a unique data line. Further, each firing cell group in FIG. 7 can be connected to unique precharge, select, datasel and fire lines. The provision of these connections affects the minimum number of interconnects for the fluid ejection device, which typically limits the smallest width of the device.

It has been recognized that reducing the minimum set of interconnects for basic addressing can allow for a smaller printhead width. There are a number of possible approaches that can be used for reducing the number of interconnects. The double data rate firing cell control circuits discussed above represent one approach to reducing the number of interconnects. The DDR circuit allows nearly twice the number of firing resistors to be energized without changing the firing frequency or the number of input pads. This in turn allows a smaller number of data lines for a firing cell array having a given number of columns. For example, a non DDR firing cell array having 8 data lines can be replaced with a DDR configuration having 4 data lines and 1 clock line.

Other approaches can include schemes to reduce the number of select lines while maintaining functionality. Under any approach, it is desired to increase the number of drop generators per input pad, which can allow a greater number of drop generators for a given width of the fluid ejection device. A printer, for example, with more drop generators typically prints with higher quality and/or printing speed. Also, a printhead with fewer input pads typically costs less to produce and to drive than a printhead with more input pads.

Figure 8:
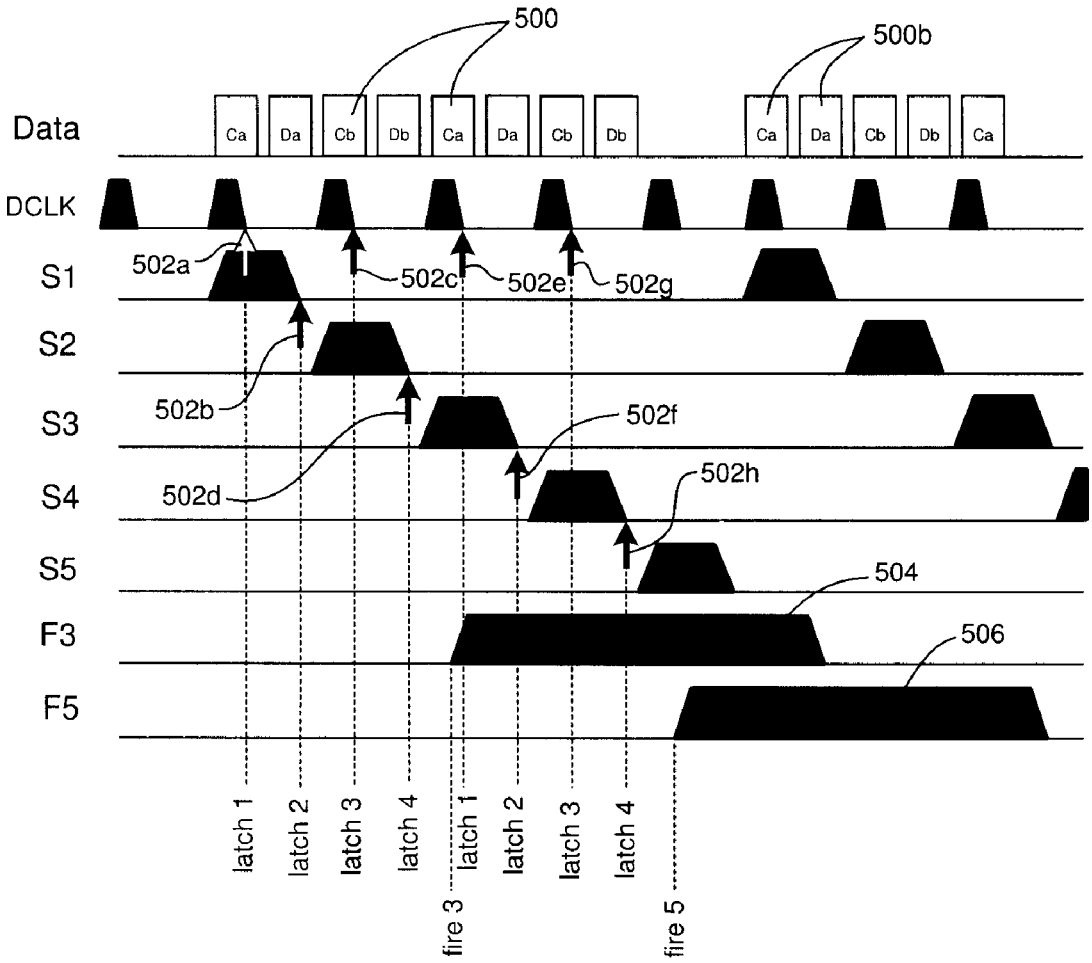
FIG. 8 is a timing diagram illustrating the operation of one embodiment of a firing cell array having combined FIRE lines.

Shown in FIG. 8 is a timing diagram outlining one method for controlling a fluid ejection cell array. This method allows a reduction in the number of FIRE lines for providing FIRE signals to a plurality of firing cell arrays. In the diagram of FIG. 8, the blocks 500 along the top row represent data that is being transmitted to the firing cells in a double data rate (DDR) circuit. The indication C denotes clocked data, while the indication D represents direct driven data. The indication "a" represents data that is provided in the first half of the DDR latch sequence, and "b" denotes data that is provided in the second half of the latch sequence. Thus, Ca denotes clocked data that is provided during the first half of the DDR latch sequence, Da denotes direct driven data that is provided during the first half of the DDR latch sequence, and so on.

The labels S1-S5 represent a group of select lines that are associated with the firing cell arrays. For example, in the configuration of FIG. 7, four firing cell arrays are shown, each having a unique data-select line. The timing diagram of FIG. 8 is represents this configuration. The designations F3 and F5 on the left side of the figure represent two firing lines that are operable to provide FIRE signals for all data transmitted during select cycles S1-S4. The additional select line S5 is provided because of the firing sequence. A nozzle cell is first precharged in one cycle, then discharged in the next cycle. Since the precharge of the next Fire group occurs at the same time as the select of the previous Fire group, these signals can be combined. However, there is always one more select line than Fire group because the precharge line of the first Fire group and the select line of the last Fire group cannot be combined with any contiguous Fire group.

The timing technique illustrated in FIG. 8 allows the capture of data during two consecutive select cycles, then firing of all nozzles during a third cycle. The data latch timing is indicated by arrows 502 in FIG. 8. In this embodiment the first four bits of data for a given data line are captured and latched during the first two select cycles S1 and S2 via DDR, as indicated at 502*a-d*. Likewise, the next four bits of data for a given data line are captured and latched during a second pair of select cycles S3 and S4 via, as indicated at 502*e-h*. Following the first two select cycles, a FIRE signal F3, indicated at 504, is given to fire the cells that captured data during the first two select cycles. A FIRE signal F5, indicated at 506, is given to fire the cells that captured data during the second pair of select cycles. After the four data capture cycles and the corresponding fire cycles, the process repeats itself, as indicated by the new group of data 500*b*.

The two consecutive data capture cycles represent twice the data that is typically captured before a FIRE cycle. In typical circuit addressing, data is usually passed to the printhead and latched during a select cycle just previous to the Fire pulse (S(n−1)). In the timing method shown in FIG. 8, data is also passed & latched on S(n−2). This data is latched and stored in the storage node capacitance (168 in FIG. 5), which provides a memory node, during the S(n−1) cycle, until it is fired during S(n).

Referring to FIG. 5, the gate of the data transistor 136 can be provided with extra capacitance, so that sufficient charge can be stored for a sufficient length of time to be evaluated when the select transistor 130 is turned on. This provides the latched storage node capacitance 168. A sufficient length of time for the data transistor to hold charge can be three select cycles, which covers the time for capture of five data bits. This will allow the nozzle arrays to store a first and second set of primitive data blocks before receiving a single Fire signal to drive both the first and second sets of primitives. For nozzles where data is latched during Sn−2, the "DATASEL" connection in this figure would be the n−2 Select signal. The state of the memory node (latched storage node capacitance 168) will only affect the state of the drive transistor 172 when it is evaluated. This occurs when the select transistor 130 is turned on. With the select transistor turned on, a positive charge on the gate of the data transistor 136 will cause the drive transistor 172 to be discharged. If the charge on this gate is low, there would not be a discharge path for the drive transistor 172, so it will remain charged.

The two-cycle data capture method for each fire group disclosed herein is used with a double data rate firing cell configuration. This two-cycle data capture method for each fire group enables a lower pin-count interface while still addressing enough nozzles because it reduces the number of FIRE lines. Specifically, this timing method allows the addressing of nozzles with fewer than select−1 Fire lines. This aspect is illustrated in FIG. 7, in which the FIRE lines FIRE_W and FIRE_X are combined through the connection to FIRE_3, and the FIRE lines FIRE_Y and FIRE_Z are combined through the connection to FIRE_5. Additionally, the precharge lines PRE_W and PRE_X are combined as PRE_W/X, as are PRE_Y and PRE_Z as PRE_Y/Z. The select lines SEL_W and SEL_X are combined as SEL_W/X, as are SEL_Y and SEL_Z as SEL_Y/Z. As another example, in one embodiment of a printhead that does not use the two-cycle data capture method outlined above, there would typically be 4 fire lines associated with 5 select lines. The two-cycle data capture method allows the same functionality with 5 select lines and only 2 fire lines. This is possible because the data latching circuit captures data for one fire line during multiple select cycles.

Figure 9:
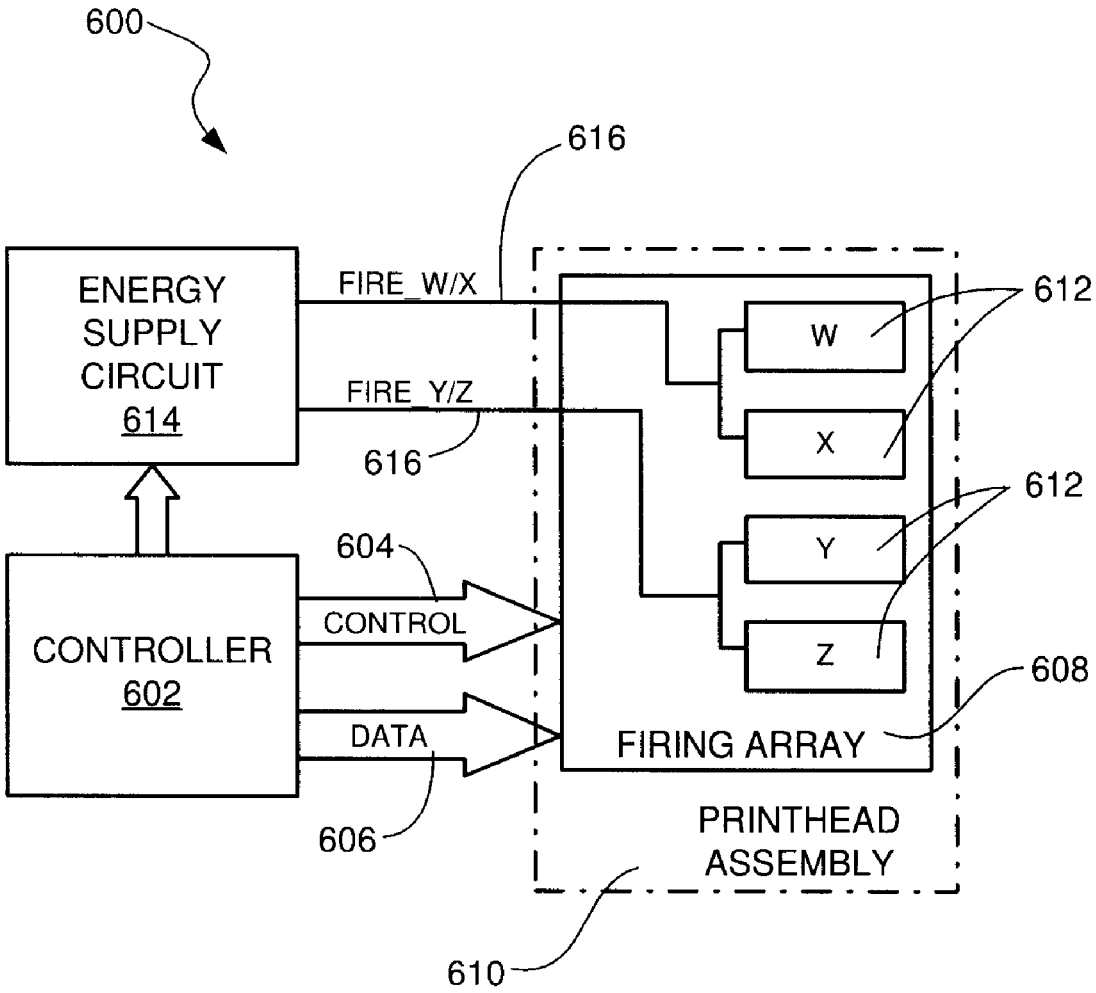
FIG. 9 is a block diagram of one embodiment of a printing system, showing the controller and energy supply circuit for powering the FIRE lines.

Another aspect of this data capture timing method is that it involves sending data with no fire pulse, and can involve sending a Fire pulse when no data was sent on one of two select cycles. The relationship of the Fire lines to the other aspects of a printer system is shown in FIG. 9. The system 600 generally includes a controller 602 that provides control signals 604 and data signals 606 to the firing array 608 of the printhead assembly 610. The firing array can include multiple nozzle arrays 612, labeled W-Z in FIG. 8. The controller is also interconnected to an energy supply circuit 614, which provides Fire signals along Fire lines 616 in response to fire pulse initiation signals from the controller. As shown in this figure, each fire line can be associated with more than one firing array.

Typically, when no data is sent during a select cycle (i.e. no dots to print), the fire pulse is not initiated. In this system, the controller (e.g. an ASIC, Application Specific Integrated Circuit, associated therewith) can be programmed to send Fire pulse initiation signals even when data was not sent during the immediately preceding select cycle Sn−1, when data was sent on the prior select cycle (Sn−2).

The two-cycle data capture method disclosed herein allows a reduction in pincount (and thus a smaller printhead) because it allows the combination of previously separate FIRE lines. When this timing approach is combined with other firing cell circuit modifications that also reduce pincount, fluid ejection devices with very small pincounts are possible. The effect on pincount of the double data rate circuitry is discussed above. Another printhead circuit modification that facilitates pincount reduction is on-board address generation, which is discussed above.

Figure 10:
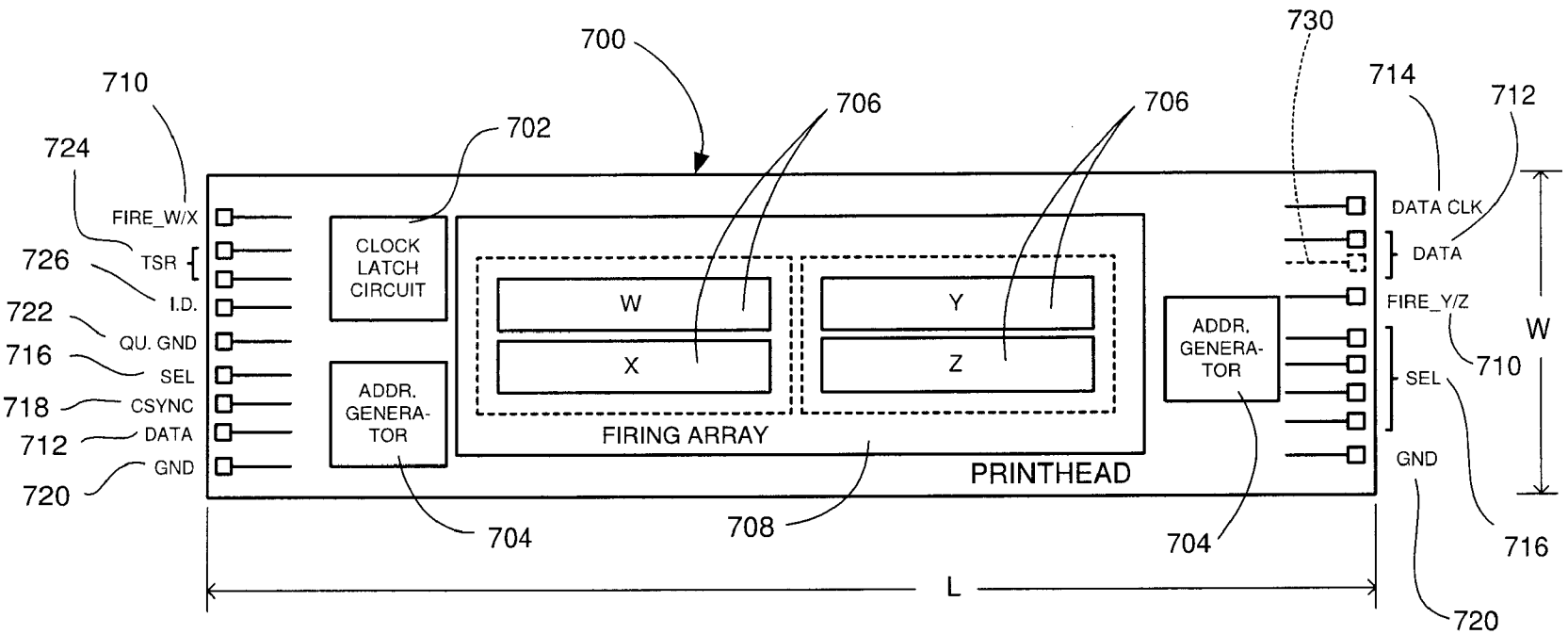
FIG. 10 is a block diagram of one embodiment of a printhead that combines a two-cycle data capture method with on-board address generation and double data rate circuitry to provide a low pincount.

Using a two-cycle data capture method as disclosed herein, in combination with onboard address generation, and the use of the double data rate clock latch circuit, the pincount for the printhead can be lower than otherwise. An example of a printhead 700 that employs all three of these pincount reduction strategies is shown in FIG. 10. This printhead includes a clock latch circuit 702 for the double data rate circuitry, and an address generator 704 for developing address signals onboard. Inputs to the address generator include the select lines 716 and the Csync line 718. Outputs are Address lines that are typically routed to the nozzle arrays in pairs. (e.g. ~ADDR1 and ~ADDR2 in FIG. 5). Six outputs from the Address Generator is a common number, but more or less can be used. Six addresses can be combined as pairs to create 15 different pair combinations (e.g. 1&2, 1&3, etc.).

Since the outputs from an Address Generator are not always valid (sometimes the register is busy shifting, etc.), two Address Generators are used and configured such that one is always outputting valid address signals. This allows continuous printing, so that printing doesn't have to wait while the address generator is shifting. While the system prints using the nozzles associated with the "valid" address generator, the other is getting setup. The clock latch and address generation circuits provide data and control to multiple firing cell groups 706, labeled W-Z, that are part of a firing array 708.

In the embodiment of FIG. 10, the two-cycle data capture method allows the use of two Fire lines 710 to control four firing cell groups, rather than four Fire lines. The use of the double data rate circuitry replaces a larger number of data lines with a smaller number of data lines 712 plus a data clock line 714, and the on-board address generation replaces a larger number of address lines with a smaller number of select lines 716 and a CSYNC line 718. Other lines that are shown, such as ground lines 720, quiet ground line 722, the TSR (thermal sense resistor) lines 724, and the Identification line 726 perform functions that are understood by those of skill in the art.

In this embodiment, the printhead 700 has 18 total pins, and can address up to 336 ink jet nozzles in the firing array at an acceptable addressing frequency. In another embodiment, one of the data pins 730 is eliminated, and the firing array can still support 204 firing nozzles with 17 pins at an acceptable addressing frequency. As shown in FIG. 10, one half of the pins can be provided on one end of the printhead die, and the remainder on the opposing end, to further reduce the width of the die. More generally, the two-cycle data capture method disclosed herein, in combination with other pincount reduction approaches that allow fewer select lines and data lines, can allow fewer than 20 pins to drive more than 300 nozzles. This approach also allows addressing of small nozzle arrays (below ~400 nozzles), with a very low interconnect count. Reduction in pincount also allows a favorable silicon aspect ratio. Because the pincount is low and the circuit layout is compact, the length-to-width ratio (L to W in FIG. 10) is larger—e.g. from more than 5:1 to more than 10:1 in a printhead circuit with Select and Fire lines.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A fluid ejection device, comprising:

two groups of firing cells, sharing a common fire signal and a common address selection mechanism, each firing cell having a drop generator for ejecting fluid and a dynamic memory addressable by the common address selection mechanism;

circuitry interfacing to a data line, a data clock, and three select lines carrying three select signals active at separate times;

a first of the groups being operable to latch first data to a first subset of firing cells on a first clock active cycle and first select signal, and to latch second data to a second subset of firing cells on a second clock active cycle and second select signal;

a second of the groups being operable to receive third data to a third subset of firing cells when the clock is inactive and during the first select signal, and receiving fourth data to a fourth subset of firing cells when the clock is inactive and during the second select signal; and circuitry for receiving the common fire signal during a third select signal and held active for multiple select cycles wherein the dynamic memory is configured to hold the first, second, third, and fourth data through the entire active common fire signal.

2. A fluid ejection device in accordance with claim 1, further comprising:

two additional select lines carrying two additional select signals active at separate times; and two additional groups of firing cells, sharing a select line both to latch data therefor, and to start the common fire signal for the first two groups of firing cells.

3. A fluid ejection device in accordance with claim 1, wherein the common address selection mechanism comprises an address generator sharing a common circuit substrate with the groups of firing cells.

4. A fluid ejection device in accordance with claim 3, having less than 20 electrical contacts for circuitry disposed upon a common substrate of the fluid ejection device, and having more than 200 firing cells.

5. A fluid ejection device, comprising:

two groups of firing cells, sharing a common fire signal and a common address selection mechanism, each firing cell having a drop generator for ejecting fluid and a dynamic memory addressable by the common address selection mechanism;

circuitry interfacing to two data lines, a data clock, and three select lines carrying three select signals active at separate times;

a first of the groups being operable to latch first data to a first subset of firing cells on a first clock active cycle and first select signal, and to latch second data to a second subset of firing cells on a second clock active cycle and second select signal;

a second of the groups being operable to receive third data to a third subset of firing cells when the clock is inactive and during the first select signal, and receiving fourth data to a fourth subset of firing cells when the clock is inactive and during the second select signal; and circuitry for receiving the common fire signal during a third select signal and held active for multiple select cycles wherein the dynamic memory is configured to hold the first, second, third, and fourth data through the entire active common fire signal.

6. A fluid ejection device in accordance with claim 5, further comprising:

two additional select lines carrying two additional select signals active at separate times; and two additional groups of firing cells, sharing a select line both to latch data therefor, and to start the common fire signal for the first two groups of firing cells.

7. A fluid ejection device in accordance with claim 5, wherein the common address selection mechanism comprises an address generator sharing a common circuit substrate with the groups of firing cells.

8. A fluid ejection device in accordance with claim 5, having 17 electrical contacts for circuitry disposed upon a common substrate of the groups of firing cells, and having 204 firing cells.

9. A fluid ejection device, comprising:

a silicon die, having an array of n groups of fluid firing cells, actuable via less than n−1 fire lines and less than n−1 select lines, each unique pair of groups being coupled to shared select and fire lines, each firing cell including dynamic memory sufficient to hold data through three select cycles;

a clock latch circuit, configured to receive data via two data lines, and to latch first data to a first subset of firing cells on a first clock active cycle and first select signal, and to latch second data to a second subset of firing cells on a second clock active cycle and second select signal;

a second of the groups being operable to receive third data to a third subset of firing cells when the clock is inactive and during the first select signal, and receiving fourth data to a fourth subset of firing cells when the clock is inactive and during the second select signal; and logic circuitry, configured to receive a common fire signal during a third select signal and held active for multiple select cycles wherein the dynamic memory is configured to hold the first, second, third, and fourth data through the entire active common fire signal.

10. A fluid ejection device in accordance with claim 9, further comprising a common address selection mechanism, disposed on the die, comprising an address generator configured to address the dynamic memory of the fluid firing cells.

11. A fluid ejection device in accordance with claim 10, wherein the address generator comprises two address generators, disposed on the die, configured to alternately provide address and select signals to the groups of firing cells.

12. A fluid ejection device in accordance with claim 9, wherein n is selected from the group consisting of two and four.

13. A fluid ejection device, comprising:

two groups of firing cells, sharing a common fire signal and a common address selection mechanism, each firing cell having a drop generator for ejecting fluid and a dynamic memory addressable by the common address selection mechanism;

circuitry interfacing to three data lines, a data clock, and three select lines carrying three select signals active at separate times;

a first of the groups being operable to latch first data to a first subset of firing cells on a first clock active cycle and first select signal, and to latch second data to a second subset of firing cells on a second clock active cycle and second select signal;

a second of the groups being operable to receive third data to a third subset of firing cells when the clock is inactive and during the first select signal, and receiving fourth data to a fourth subset of firing cells when the clock is inactive and during the second select signal; and circuitry for receiving the common fire signal during a third select signal and held active for multiple select cycles wherein the dynamic memory is configured to hold the first, second, third, and fourth data through the entire active common fire signal.

14. A fluid ejection device in accordance with claim 13, further comprising:

two additional select lines carrying two additional select signals active at separate times; and two additional groups of firing cells, sharing a select line both to latch data therefor, and to start the common fire signal for the first two groups of firing cells.

15. A fluid ejection device in accordance with claim 13, wherein the common address selection mechanism comprises an address generator sharing a common circuit substrate with the groups of firing cells.

16. A fluid ejection device in accordance with claim 13, having 18 electrical contacts for circuitry disposed upon a common substrate of the groups of firing cells, and having 336 firing cells.

* * * * *